United States Patent [19]

Gerbracht

[11] 4,215,529

[45] Aug. 5, 1980

[54] CABLE WINDING APPARATUS

[75] Inventor: Osceola J. Gerbracht, Seattle, Wash.

[73] Assignee: Norfin, Inc., Seattle, Wash.

[21] Appl. No.: 953,363

[22] Filed: Oct. 23, 1978

[51] Int. Cl.[2] ..... H01B 13/00; H01B 13/06

[52] U.S. Cl. ..... 57/6; 57/282; 57/297; 156/47

[58] Field of Search ..... 57/1 R, 3, 6, 7, 9, 57/59, 62, 138, 217, 212, 234–242, 251, 258, 282, 292, 295, 297, 308; 156/47, 50, 161, 433, 441

[56] References Cited

U.S. PATENT DOCUMENTS

| | | | |
|---|---|---|---|
| 2,857,731 | 10/1958 | Simcoe | 57/138 X |
| 2,895,286 | 7/1959 | O'Connell | 57/309 X |
| 3,559,390 | 2/1971 | Staschewski | 57/6 |
| 3,574,015 | 4/1971 | Blee | 156/47 |
| 3,974,016 | 8/1976 | Bondybey et al. | 156/47 X |

*Primary Examiner*—Donald Watkins
*Attorney, Agent, or Firm*—Seed, Berry, Vernon & Baynham

[57] ABSTRACT

An apparatus and method for winding thermoplastic coated strands into a composite cable wherein the strands are first twisted around one another into a cable and then heat is applied to melt the thermoplastic coating. A plurality of rotatably mounted spools of thermoplastic coated strands are rotated about a common axis while the strands are pulled from the spools. The strands are drawn together by a collimating means and then passed through a heating means before being wound onto a take-up spool.

6 Claims, 8 Drawing Figures

CABLE WINDING APPARATUS

BACKGROUND OF THE INVENTION

A problem almost universally encountered in the design of electronic devices is the harmful effect of electronic noise on the operation of such devices. One technique which has been found useful in reducing such harmful effect is the winding or twisting together of pairs or groups of insulated metal conductor wires whenever such wires pass from one part of the device to another. Such winding not only reduces the amount of electromagnetic noise radiated by wires carrying varying currents, but also reduces the amount to stray noise picked up by signal wires. In the past, the winding or twisting together of insulated conductor wire has mainly been accomplished manually, a process wich drastically limits the use of wound or twisted wire as a standard production technique, and which further produces a wound cable subject to unwinding.

The problem of machine winding a number of individual strands of material together into one composite strand or cable has been approached in many different arts. In the manufacture of rope and related materials, for example, the individual strands are twisted before being wound together, such twisting providing the force to hold the strands together in the finished rope. Methods of making glass fiber cable by coating the individual fibers with adhesive have also been developed. See for example U.S. Pat. No. 3,662,533. Such prior techniques, however, have little applicability to the winding of metal strands coated with thermoplastic insulating material. Twisting individual strands of such wire prior to winding would be impractical and ineffective. The use of adhesives, while possible, is better suited to applications in which the individual strands are thinner and more flexible than thermoplastic coated metal wire. All known winding techniques, if applied to insulated metal wire, would produce a cable with a tendency to curl, since the cable would retain a memory of the twisting of the individual wires. Finally, the large mass of spools of metal wire makes it quite difficult to design a winding machine for such wire capable of being operated at production speed without instability.

SUMMARY OF THE INVENTION

This invention provides an apparatus and a method of winding thermoplastic coated strands into a composite cable at production speeds. The individual strands are first twisted around one another into a cable, and the cable is then subjected to heat. The heat partially melts the thermoplastic insulation, and causes the strands to bond to each other and to lose their memory of having been twisted together, so that a cable having no tendency to curl is produced.

The apparatus of this invention comprises a spool housing for rotatably mounting spools of thermoplastic coated strands, pulling means for pulling strands from the spools, means for rotating the spool housing, and heating means. Rotation of the spool housing as strands are being pulled from the spools by the pulling means causes such strands to become twisted around one another into a cable. The heating means is located so as to heat such cable as it passes between the spool housing and the pulling means. Collimating means may be used to insure that the wires are drawn together into a twisted cable before the cable reaches such heating means.

These and other features and advantages of this invention will become apparent in the detailed description and claims to follow taken in conjunction with the accompanying drawings in which like parts bear like reference numerals in the various views.

DETAILED DESCRIPTION OF THE DRAWINGS

Figure 1:
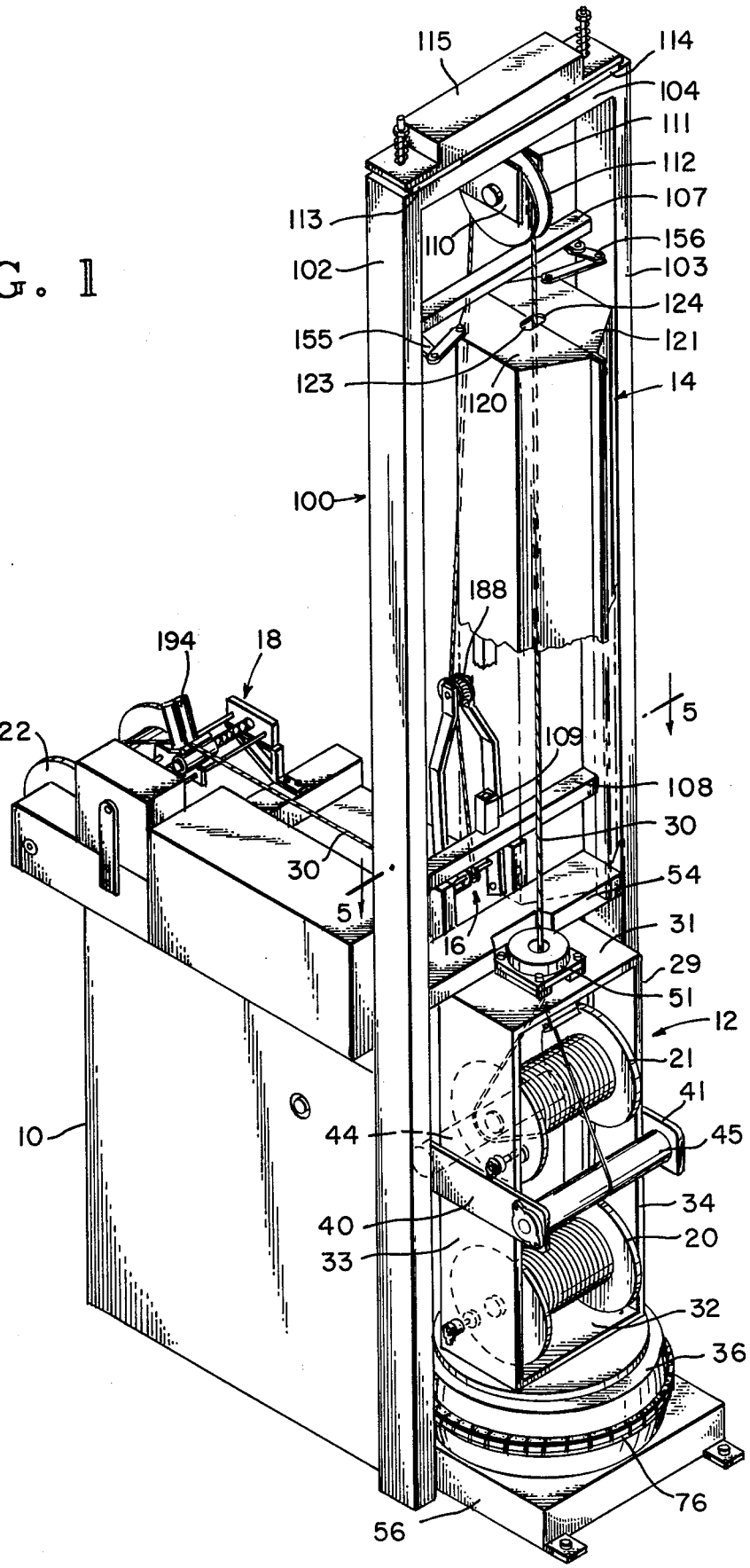
FIG. 1 is a perspective view of a cable winding apparatus according to the present invention.

FIG. 1 illustrates an apparatus according to the present invention comprising a frame 10, spool housing 12 rotatably mounted therein, heating means 14 and wire pulling means 16. The heating means and wire pulling means are shown as being mounted to frame 10, although this is merely a convenience and not necessary for carrying out the present invention. Spools 20, 21 of thermoplastic coated wire are rotatably mounted in spool housing 12, and wire from such spools is fed around pulley 112 into wire pulling means 16. The wire pulling means draws the wires from the spools while the spool housing is rotated, thereby producing a cable 30 in which the individual wire strands are twisted about one another. Such cable passes through the heating means 14 on its way to the pulling means. The heating means causes the thermoplastic insulation on the wires to soften to the point where the wires bond together and lose their memory of the twisting imparted by the rotated housing. Means, generally indicated at 18, are provided for taking up cable 30 onto spool 22 as such cable exits from the pulling means.

Although the particular apparatus described in detail herein is adapted to wind together wire from two spools, provision could readily be made for additional spools. This will generally be unnecessary, however, inasmuch as either or both of spools 20, 21 could contain cable previously produced by the apparatus depicted. Thus by repeated passes, an apparatus adapted to mount two spools 20, 21 can produce a cable consisting of any number of individual twisted strands.

Figure 2:
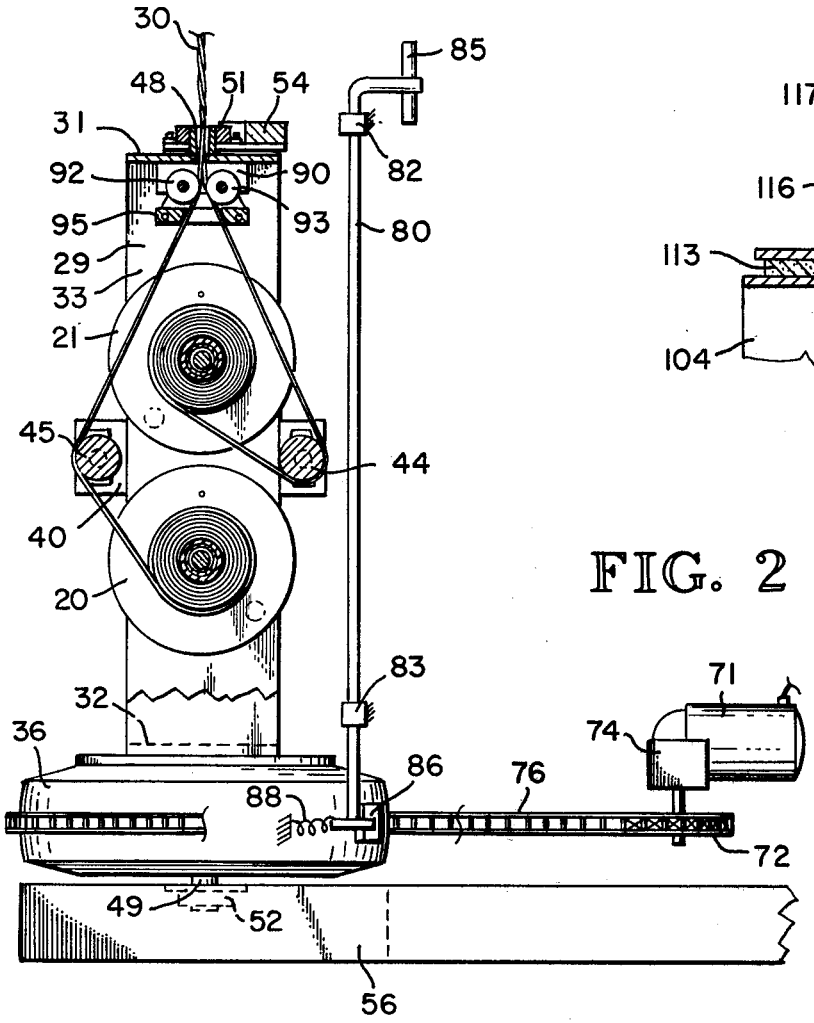
FIG. 2 is a side elevational cross-sectional view of the spool housing portion of the apparatus of FIG. 1.

Referring now to FIGS. 1 and 2, spool housing 12 comprises a rectangular frame 29 open on two sides and mounted atop a cylindrical base 36. The frame 29 consists of side frame members 33 and 34 and top and bottom frame members 31 and 32 respectively. Identical arms 40, 41 are secured to side frame members 33, 34 respectively and extend laterally therefrom. These arms mount identical rollers 44, 45. Referring to FIG. 2, shafts 48, 49 extend from the top and bottom respectively of spool housing 12, shaft 48 extending upwards from frame member 31 and shaft 49 extending downwards from cylindrical base 36. These shafts are journaled in bearings 51, 52 respectively, bearing 51 being mounted in frame member 54 and bearing 52 being mounted in base portion 56 of frame 10. Shafts 48, 49 define an axis of rotation of spool housing 12, and bearings 51, 52 are positioned such that this axis is vertical. Since spool housing 12 is intended for rotation at considerable speed, it is constructed so as to be symmetrical about this axis. Thus shafts 48, 49 are located centrally with respect to top frame member 31 and cylindrical base 36 respectively, and rollers 44, 45 are mounted so as to be equidistant from the spool housing's axis of rotation.

Figure 7:
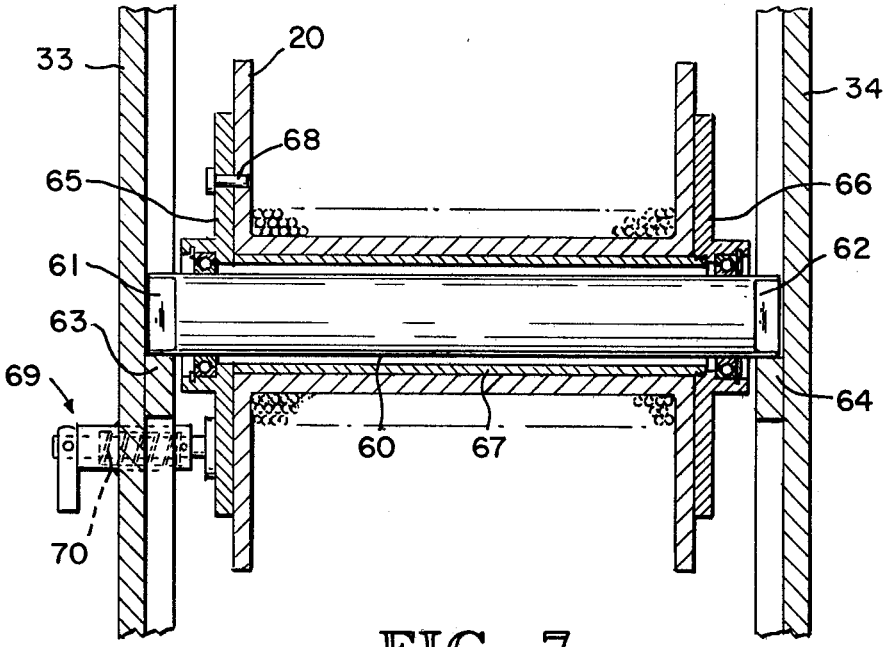
FIG. 7 is a cross-sectional view showing the manner in which a spool of wire is mounted in the apparatus of FIG. 1.

FIG. 7 illustrates the way in which spools 20, 21 are mounted in spool housing 12. Shaft 60 has flattened end portions 61, 62 which are held in slots formed on the inner surfaces of sides 33, 34 respectively, such that shaft 60 is not free to rotate. Vertical support for ends 61, 62 is respectively provided by shoulders 63, 64. End plates 65, 66 are journaled for rotation on shaft 60. Tubular member 67 extends between plates 65, 66 and has an outer diameter corresponding to the inner diameters of spool 20. Tubular member 67 is welded to end plate 65 and threaded to end plate 66, so that plate 66 can be removed for mounting spool 20 on the tubular member. Pin 68 is carried by plate 65 and is received in an opening in spool 20 to prevent rotation of spool 20 with respect to the end plates. Braking or friction means 69 is carried by side frame member 33 and biased by spring 70 into contact with plate 65. The friction means prevents overrunning of the spools, especially when the apparatus is stopped.

Rotation of spool housing 12 is effected by variable speed electric motor 71 (FIG. 2) which drives pulley 72 through appropriate drive reduction means 74. Drive chain 76 connects pulley 72 with cylindrical base 36. A groove (not shown) or other suitable means may be used around the circumference of cylindrical base 36 to keep chain 76 from slipping off. FIG. 2 also illustrates braking means for the spool housing, consisting of shaft 80 journaled at points 82, 83 to frame 10 and having actuating handle 85 and friction member 86. Spring 88 connected between friction member 86 and a suitable point on frame 10 holds friction member 86 away from contact with cylindrical base 36 during operation of the winding apparatus. When winding has been completed, the spool housing may quickly be brought to a stop by applying pressure to actuator handle 85 so as to bring the friction member to bear against the rotating cylindrical base. Other braking devices could, of course, be used.

As indicated in FIG. 2, upper shaft 48 is hollow and open ended so as to permit passage of the twisted wires 30 therethrough. Similarly, an opening is provided in top frame member 31 directly under shaft 48. Flanges 90, only one of which is shown in FIG. 2, depend from frame member 31 on either side of such opening, and serve to mount rollers 92, 93 and fairlead 95. Fairlead 95 has a rectangular opening whose longest dimension is in the plane of the drawing in FIG. 2. Fairlead 95 and rollers 92, 93 serve to prevent abrasion of the wire as it leaves the spool housing and also insure that the wires from the two spools will be fully twisted around one another into cable 30 upon leaving such housing. FIG. 2 also illustrates the paths of the wires from the spools over rollers 44, 45 and from there through fairlead 95 and shaft 48. Such rollers provide unobstructed paths for the individual wires and also help insure that the wires will be fully twisted together upon leaving the housing.

Referring again to FIG. 1, a vertical mast 100 is provided which rises above frame 10 at a point immediately adjacent spool housing 12. The mast comprises side rails 102, 103, top cross member 104, upper and lower cross arms 107, 108 respectively, and a vertical member 109 shown in cross section in FIG. 5. Flanges 110, 111 depend from the under side of cross member 104 and mount pulley 112. Cross arms 107, 108 extend horizontally between and are fixed to side rails 102, 103 with vertical member 109 extending between such cross arms. Cross arms 107, 108 together with vertical member 109 mount heating means 14 and its associated actuating means, presently to be described. Twisted cable 30 rises vertically from the spool housing, passes through heating means 14, around pulley 112 and then descends to the wire pulling means 16.

Figure 3:
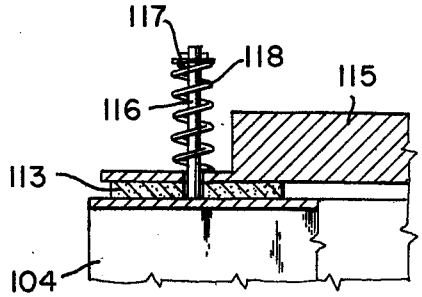
FIG. 3 is a detailed cross-sectional view of the damping means of the apparatus of FIG. 1.

Despite the fact that spool housing 12 is constructed so as to be symmetrical about its axis of rotation, rotation of the spool housing at the high rates required for winding wire at production speeds can cause considerable vibration of the apparatus. Such vibration is principally caused by the shifting of the centers of mass of spools 20 and 21 as wire is drawn therefrom. A vibration damping means which has been found effective comprises strips of elastic or compressible material 113, 114 such as cork or rubber mounted on top cross member 104 near its ends, and a mass 115 mounted on and extending between such elastic layers as illustrated in FIG. 1. FIG. 3 shows in detail how one end of mass 115 is attached to top member 104, the attachment means comprising shaft 116 extending upwards from top member 104 through openings in elastic material 113 and mass 115. A stop 117 is mounted near the top of shaft 116, and spring 118 acts between stop 117 and mass 115. As shown in FIG. 1, a similar attachment means is associated with elastic material 114 at the other end of member 104. By threading shaft 116 and stop 117, the vibration damping means can be made adjustable.

Figure 5:
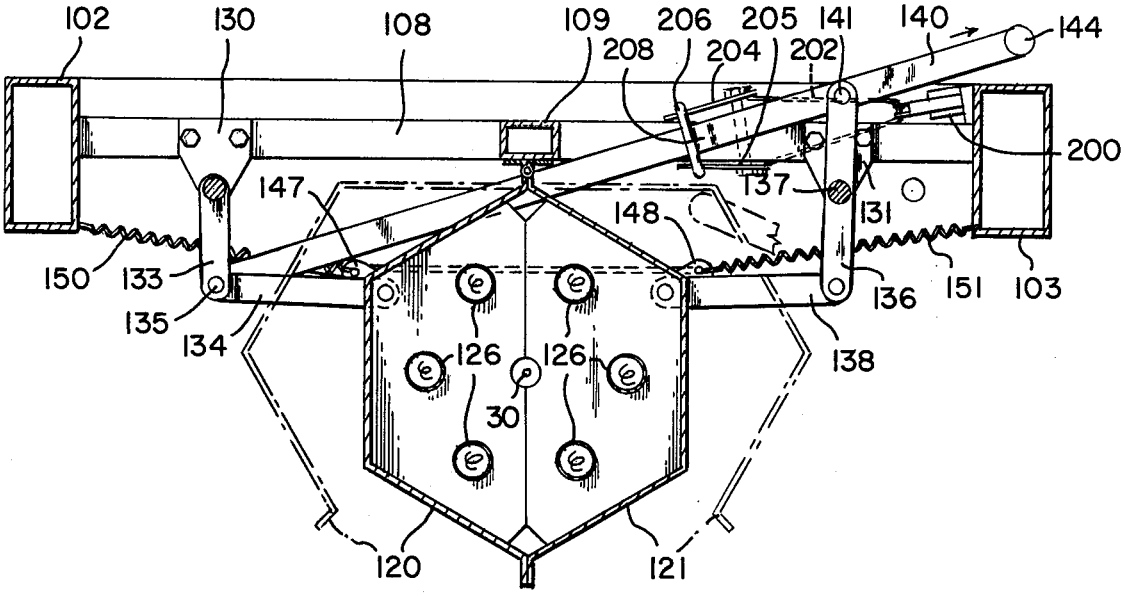
FIG. 5 is a cross section taken along the line 5—5 of FIG. 1.

Referring now to FIGS. 1 and 5, heating means 14 comprises a vertically disposed cylindrical shell of hexagonal cross section consisting of similar half sections 120, 121. Both half sections are hingedly mounted to vertical member 109 such that they can move between open and closed positions, as indicated in phantom and solid lines respectively in FIG. 5. Cutouts 123, 124 are located in the upper surface of half sections 120, 121 respectively such that when such sections are in their closed position, the cutouts form a single aperture through which cable 30 can pass. Similar cutouts, not shown, are located at similar positions to form an aperture in the lower surface of half sections 120, 121. Such apertures are the only openings in the shell formed by such half sections in their closed position. Vertically disposed heat lamps 126 are mounted three to each half section in such positions that when the half sections are in their closed position, the heat lamps are approximately evenly spaced around the path of cable 30. Thermostat means (not shown) may also be mounted in one or both of the half sections for achieving automatic control of temperature.

The actuating means for moving half sections 120, 121 between open and closed positions is illustrated in FIGS. 1 and 5 and includes the hinge plates 130, 131 bolted or otherwise fixed to lower cross member 108. Link 133 is pivotally connected to hinge plate 130, and link 134 is pivotally connected between link 133 at point 135 and the lower surface of half section 120. Link 136 is pivotally connected to hinge plate 131 at point 137, and link 138 pivotally connects link 136 to the lower surface of half section 121. Arm 140 is pivotally connected to link 136 at point 141 and to links 133 and 134 at point 135, and is provided with an operating handle 144 at one end. Half sections 120, 121 are provided with tabs 147, 148, and tension springs 150, 151 respectively connect such tabs with side rails 102, 103. Pulling on handle 144 to the right as viewed in FIG. 5 moves the half sections against the tension of springs 150, 151 and into their closed position. The arm and half sections are held in such closed positions by a safety release mechanism hereinafter described. When arm 140 is released by the release mechanism, springs 150, 151 pull the half sections into their open position.

As illustrated in FIG. 1, hinge and linkage assemblies generally indicated at 155 and 156 link the upper surface of half sections 120, 121 to upper cross member 107. Assemblies 155 and 156 are each similar to the assembly comprising hinge plate 130 and linkages 133 and 134 previously described.

Figure 4:
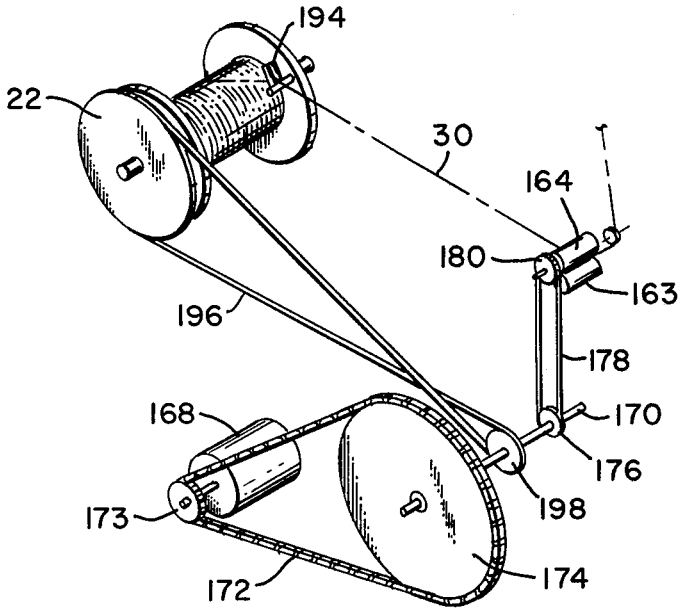
FIG. 4 is a perspective view of the drive means for the pulling means and take up means of the apparatus of FIG. 1.
Figure 6:
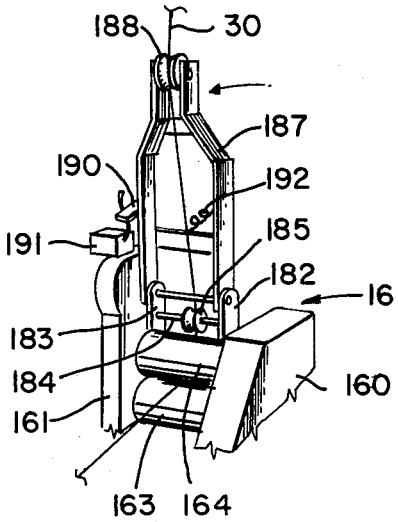
FIG. 6 is a perspective view of the pulling means of the apparatus of FIG. 1.

Wire pulling means 16 is mounted on frame 10 on the opposite side of mast 100 from the spool housing. As illustrated in FIG. 6, the wire pulling means comprises mounting blocks 160, 161 and pinch rollers 163, 164 mounted therebetween. Mounting block 161 contains a portion of the means for driving the pinch rollers. As shown in FIG. 4, such means includes variable speed electric motor 168 which drives shaft 170 by means of chain 172 and sprockets 173, 174. Pulley 176 on shaft 170 drives belt 178 which in turn drives pulley 180 mounted on the shaft of pinch roller 164. Pulley 180 is contained within the mounting block 160 shown in FIG. 6.

Brackets 182, 183 are also mounted on mounting blocks 160, 161. These brackets mount axle shaft 184 which supports guide roller 185, and also serve to pivotally mount the trip arm 187. A second guide roller 188 is mounted on trip arm 187 at its distal end. Cam switch contact means 190 is affixed on one side of arm 187, such contact means being located so as to contact the operator arm of microswitch 191 mounted on the block 161 or any other convenient portion of frame 10. A tension spring 192 is connected between trip arm 187 and lower cross member 108 of mast 100 so as to bias the trip arm 187 in the direction indicated by the arrow in FIG. 6. During normal operation of the winding apparatus, pinch rollers 163, 164 pull cable 30 out of the spool housing, through the heating means, around pulley 112 and across guide rollers 188 and 185. The tension in cable 30 caused by such pulling causes the cable to bear against guide roller 188 and move the trip arm against the spring in a direction opposite to that indicated in FIG. 6, to a position wherein the force of the cable bearing against guide 188 just balances the tension of the spring. In this position the contact means 190 will not trip the microswitch 191, but motion of the trip arm in either direction from this position will activate the switch. Such motion can result from either an increase or decrease in cable tension, resulting from a snag in the cable at the spool housing or from a break in the cable. Microswitch 191 can thus be used to control various apparatus functions as appropriate. One such function, already referred to, is to release arm 140, causing half sections 120, 121 to open, to avoid overheating of the cable contained therein.

Figure 8:
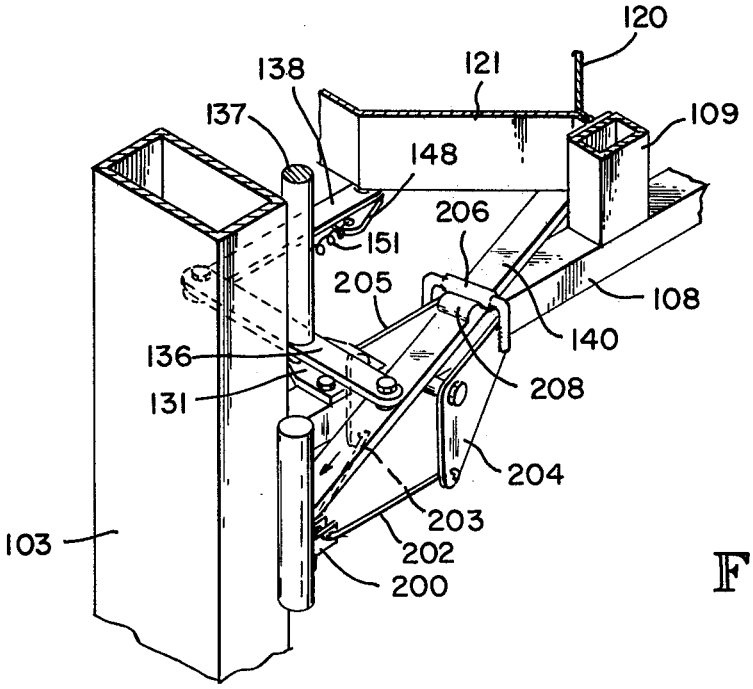
FIG. 8 is a perspective view of the release mechanism of the apparatus of FIG. 1.

The release mechanism for arm 140 is illustrated in FIG. 8. A solenoid (partially shown at 200) is mounted to side member 103 of mast 100 at a point below lower cross arm 108. The plunger of solenoid 200 is connected via links 202, 203 to bell cranks 204, 205, and the bell cranks mount locking member 206 therebetween. When the solenoid is energized, the locking member is held in the position shown in FIG. 8 in which it engages stop 208 on arm 140 and prevents movement of the arm in a direction towards number 109. Half sections 120, 121 are thereby held in their closed position. However, when the solenoid is deenergized by means responsive to the position of microswitch 191, downward pressure exerted by locking member 206 is removed and arm 140 is free to move in the direction of number 109 (FIG. 8) under the force of springs 150, 151, opening half sections 120, 121. Other examples of functions which may be controlled by microswitch 191 are the operation of the heating means 14, pinch rolls 163, 164 and the spool housing 12.

The illustrated cable winding apparatus also comprises means for reeling the finished cable onto a spool. Such means is conventional and need not be described in detail. Referring generally to FIG. 1, the reeling means comprises means for mounting take-up spool 22, roller guide means 194 and means for moving such roller guide means back and forth the width of spool 22 such that the cable will be laid evenly thereon. Spool 22 may be driven by slip belt 196 which in turn is driven by pulley 198 on shaft 170 as illustrated in FIG. 4. Roller guide means 194 may be moved back and forth by any conventional guide means driven by an appropriate gear linkage operatively connected to take-up spool 22.

In the apparatus herein described, the means for rotating the spool housing and the means for rotating the pinch rolls are independent of each other. By adjusting these rotation rates relative to one another, the operator can vary the number of turns per unit length in the finished cable. The means for rotating the spool housing and the pinch rolls could of course be interrelated or combined such that the operator would need to vary only one control to adjust the relative rates and turns per unit length.

While the preferred embodiment of this invention has been illustrated and described herein, it should be understood that variations will become apparent to one skilled in the art. Accordingly, the invention is not to be limited to the specific embodiment illustrated and described herein and the true scope and spirit of the invention are to be determined by reference to the appended claims.

What is claimed is:

1. An apparatus for producing a composite cable from linear conductive strands having a thermoplastic coating thereon, comprising:

a rotatably mounted spool housing including a plurality of mounting means for rotatably mounting spools of the thermoplastic coated strands;

pulling means for pulling strands from spools mounted in the spool housing;

collimating means including a fairlead mounted in the spool housing along the axis of rotation of the housing, the collimating means positioned to draw together strands pulled from the spools by the pulling means.

power means for rotating the spool housing such that a plurality of strands pulled from spools in the rotating spool housing by said pulling means will be twisted about one another, and;

heating means for heating the thermoplastic coatings of the twisted strands as the the strands pass from the collimating means to the pulling means so as to bond such strands into a composite cable.

2. The apparatus of claim 1, wherein two said mounting means are provided, each so positioned such that the spool mounted therein has its axis of rotation substantially perpendicular to the axis of rotation of the spool housing and substantially parallel to the axis of rotation of a spool mounted in the other mounting means.

3. The apparatus of claim 2, wherein the mounting means are positioned such that spools mounted therein are positined in spaced relation along the axis of rotation of the spool housing, and wherein the spool housing further includes two guides located between said spools and positioned in spaced-apart relationship to each other on opposite sides of the axis of rotation of the spool housing and having guide surfaces approximately parallel to the axis of rotation of spools mounted in the mounting means.

4. The apparatus of claim 1, wherein said pulling means comprises pinch rollers and drive means therefor.

5. The apparatus of claim 4, wherein the heating means comprises an enclosure having openings suitable for permitting passage of the thermoplastic coated plastic strands therethrough, and having heat lamps mounted therein.

6. A method of producing a composite cable from linear electrically conductive strands having thermoplastic coatings thereon, comprising the steps of:

rotatably mounting a plurality of spools of the thermoplastic coated strands;

pulling strands from each of the spools toward a common point;

rotating the spools simultaneously with pulling such that strands from the respective spools are twisted about one another;

running the strands through a collimator and fairlead positioned along the axis of rotation to draw together the strands pulled from the spools; and heating the coatings of the strands while in the twisted condition to bond the individual strands into a composite cable.

* * * * *